United States Patent [19]

Bauer, deceased

[11] 4,262,170

[45] Apr. 14, 1981

[54] MICROPHONE SYSTEM FOR PRODUCING SIGNALS FOR SURROUND-SOUND TRANSMISSION AND REPRODUCTION

[76] Inventor: Benjamin B. Bauer, deceased late of 92 Red Fox Rd., Stamford, Conn. 06903, by Ida Bauer, executrix

[21] Appl. No.: 19,811

[22] Filed: Mar. 12, 1979

[51] Int. Cl.[3] ..... H04S 3/02

[52] U.S. Cl. ..... 179/1 GQ

[58] Field of Search ..... 179/1 GQ, 1 GH, 1 DM, 179/100.45 T, 100.1 TD, 1 G

[56] References Cited

U.S. PATENT DOCUMENTS

| | | | |
|---|---|---|---|
| 4,072,821 | 2/1978 | Bauer | 179/1 GQ |
| 4,085,291 | 4/1978 | Cooper | 179/1 GQ |
| 4,096,353 | 6/1978 | Bauer | 179/1 GQ |

FOREIGN PATENT DOCUMENTS

| | | | |
|---|---|---|---|
| 1414166 | 11/1975 | United Kingdom | 179/1 GQ |

*Primary Examiner*—Douglas W. Olms

*Attorney, Agent, or Firm*—Parmelee, Johnson, Bollinger & Bramblett

[57] ABSTRACT

A system including a compact array of microphones in combination with signal combining circuitry, especially suited for use with surround-sound sources, for producing two composite signals LT and RT corresponding to those required by an SQ-matrix-type quadraphonic system to establish the directional position of the sound sources. The signals produced by selected ones of the microphones are combined to produce an auxiliary signal which contains, to the extent they are present, equal proportions of signals corresponding to the signals LF, RF, LB and RB of the SQ quadraphonic system which exhibit an equal angular relationship respecting corresponding signals in a composite signal representing the sum of LT and RT. The auxiliary signal enables decoding of the directional signals in the 4-3-4 or the $\theta$-3-4 modes.

10 Claims, 12 Drawing Figures

Fig. 4
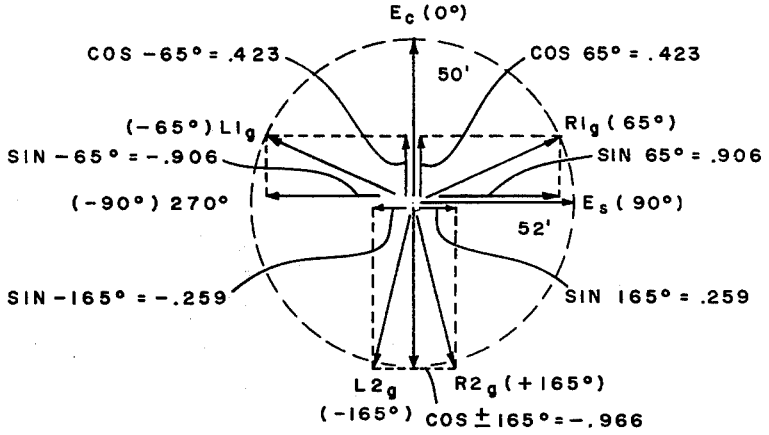
Fig. 5
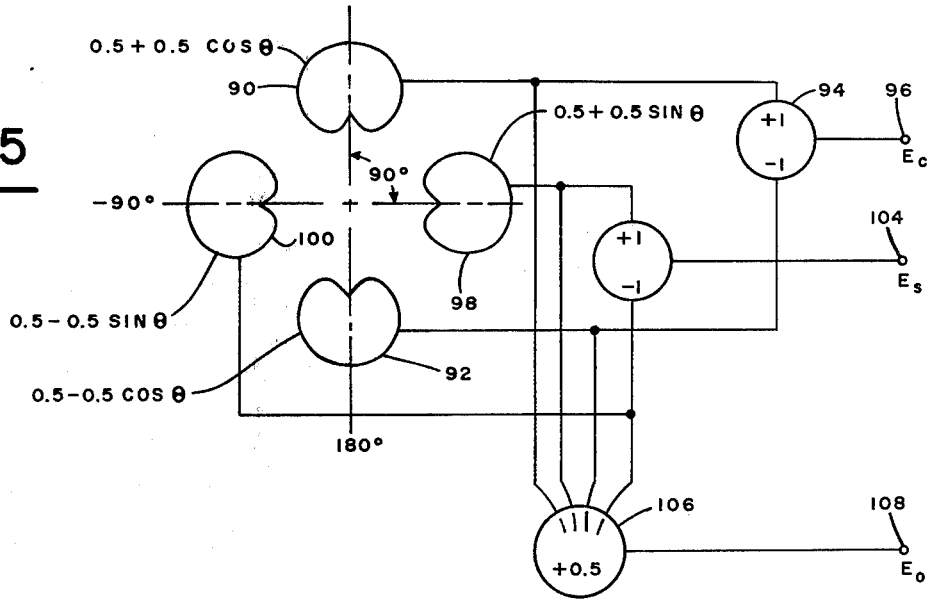
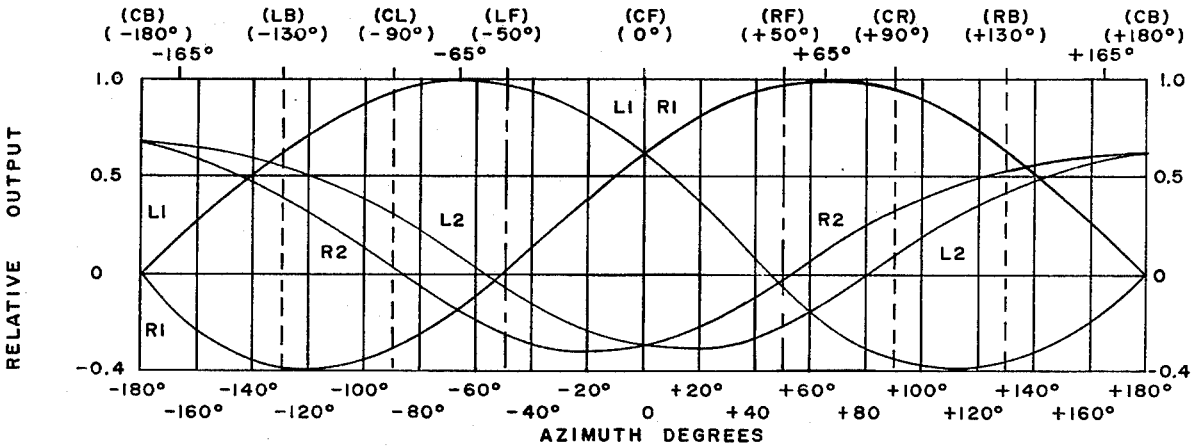
Fig. 6A

Fig. 6B
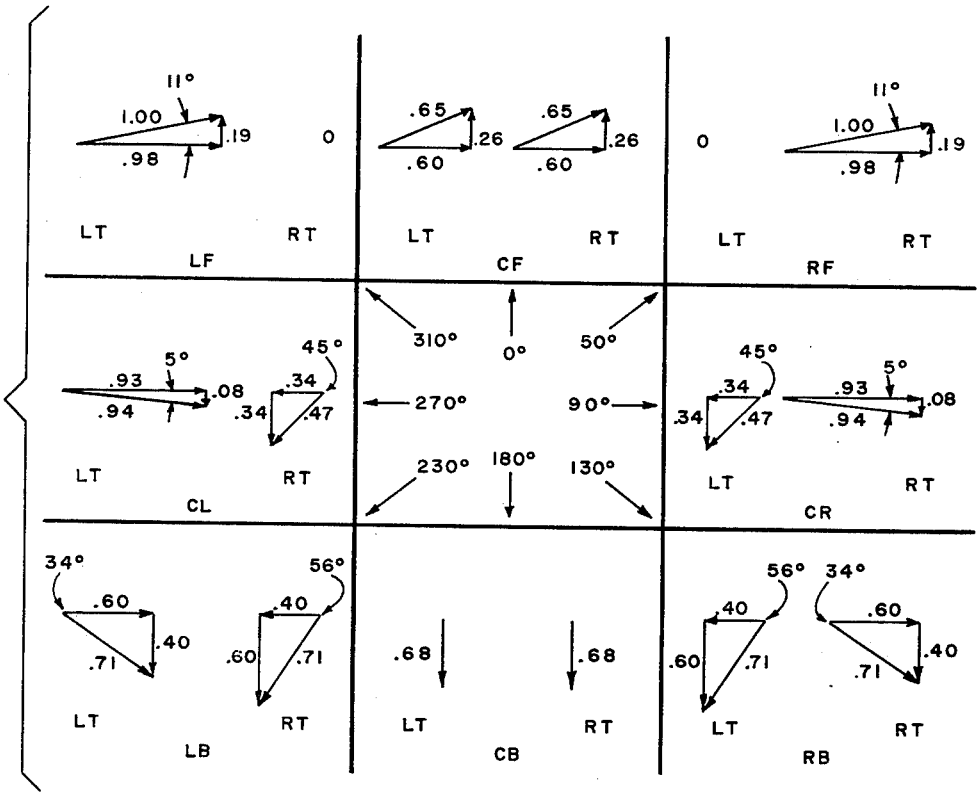
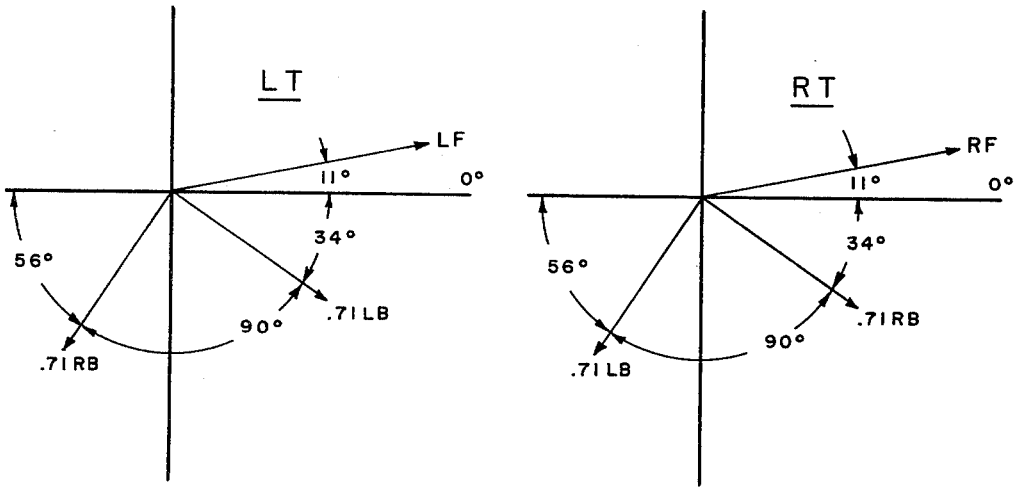
Fig. 6C

MICROPHONE SYSTEM FOR PRODUCING SIGNALS FOR SURROUND-SOUND TRANSMISSION AND REPRODUCTION

BACKGROUND OF THE INVENTION

This invention relates to surround-sound systems and more particularly to a compact array of microphones and signal-combining circuitry especially suited for furnishing signals intended for use with my invention described in co-pending application Ser. No. 018,967 entitled, "Compatible Four-Channel Radio Broadcast and Receiving System". The present invention is an improvement over my previous inventions in the U.S. Pat. Nos. 4,072,821 and 4,096,353. These patents describe embodiments of my invention capable of producing two-channel SQ coded signals corresponding to directional sounds impinging upon the microphone arrays from various directions around the compass. These coded signals can be decoded using the decoders described in the co-pending application in the 4-2-4 mode. The present application teaches how to generate a new function T in the microphone systems described in the aforementioned patents in order to enable the transmission and decoding of the directional signals to take place in the 4-3-4 or the $\theta$-3-4 modes, as hereinafter explained.

SUMMARY OF THE INVENTION

The surround-sound reproduction systems described in the aforementioned co-pending application accept directionally identified signals which are applied to the input terminals of the encoders described therein, either discretely, or by "panning" or channeling these signals between two or more terminals to reproduce the effect of intermediate directions; this method of encoding signals being most commonly used in the recording technology. By contrast, the microphone systems described in the aforementioned two patents and the improvements thereof in this application, are placed in the sound field produced by the sound sources to be recorded or broadcast, and which after being operated upon by the signal-combining circuitry associated with the microphone produces two encoded signals, LT and RT containing coded SQ information corresponding to the direction of sound impinging upon the microphone. Therefore, the system acts both as a transducer of spatial acoustical signals and an encoder. Such a microphone system, therefore, can be characterized as a "spatial" microphone system; albeit it also can be referred to as a "coincident" or a "intensity" microphone system, because its transducers are aligned in space-coincidence and are designed to deliver signals which vary in intensity as a function of direction of sound arrival.

An important feature of this invention stems from the discovery that the same transducer of spatial acoustical signals LT and RT referred to immediately above also can be suitably interconnected to provide the function T necessary to achieve the 4-3-4 or $\theta$-3-4 method of operation described in the co-pending application. Other interrelationships between the microphone described herein and the decoders of the co-pending patent application will become clear as this specification proceeds.

While the description herein in the main is in terms of signals arriving from four specific cardinal directions, e.g. LF (Left Front), RF, (Right Front), LB (left Back), and RB (Right Back), it is to be understood that the microphone array herein described responds to signals from any direction, $\theta$, and offers the capability of transmitting these signals over 2 or 3 transmission channels for decoding these signals for display over 4 loudspeakers. It should be understood that by suitable combination or interpolation of output signals a smaller or a larger number of loudspeakers than 4 may be used. Therefore the scope of this invention should not be considered as being limited to a particular number of input and output signals.

BRIEF DESCRIPTION OF THE DRAWINGS

The invention is described in reference to the following drawings:

FIG. 4 is an additional explanatory diagram for FIG. 2A;

FIG. 5 is a modification showing constructional details of a commercial microphone system;

FIG. 6A is a clarifying representation of the output signals within the microphone system;

FIG. 6B is an explanatory diagram demonstrating the formation of SQ -encoded signals within the microphone system;

FIG. 6C is a resultant phasor diagram of signals LT and RT produced by the microphone system according to the invention;

DESCRIPTION OF THE PREFERRED EMBODIMENTS

Figure 1:
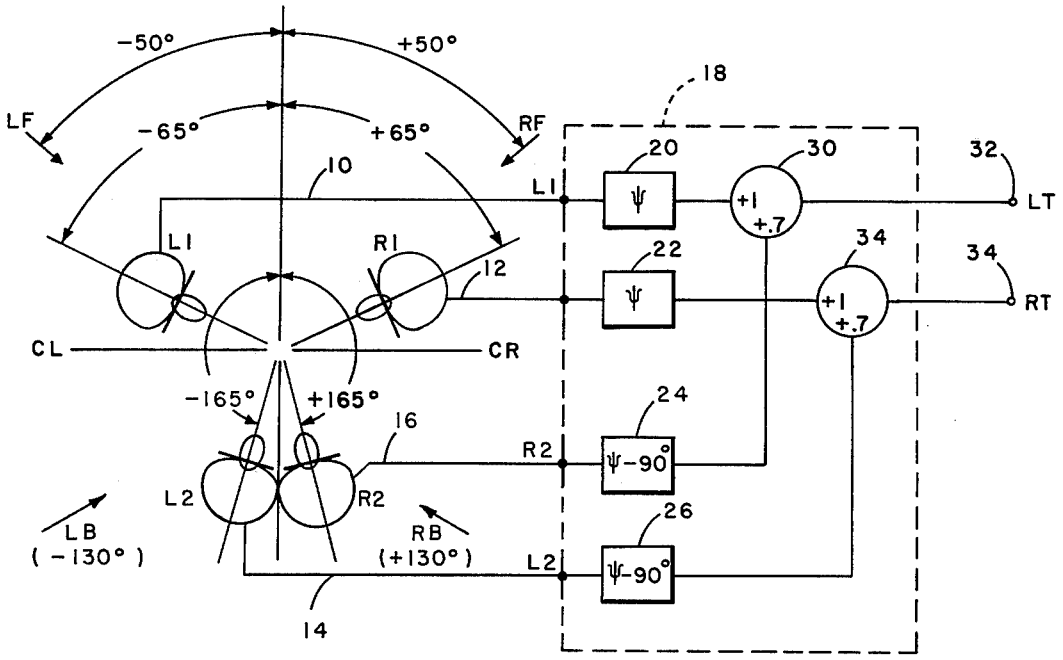
FIG. 1 is a schematic diagram of the microphone system reproduced for explanatary purposes from the aforementioned U.S. Pat. No. 4,096,353.

As background for understanding of the present invention, some of the embodiments of the referred to U.S. Pat. Nos. 4,072,821 and 4,096,353 will be illustrated. Reference is made to FIG. 1 which illustrates the essential features of the system described in applicant's U.S. Pat. No. 4,072,821. In that system, four bi-directional microphones and a single omni-directional microphone are supported on a common vertical axis and their output signals combined in a manner so as to define limacon patterns of revolution each corresponding to the equation: $\rho(\theta)=0.3+0.7\cos\theta$, where $\rho$ is the fraction of the maximum sensitivity of the sensor as a function of angular deviation $\theta$ from the positive direction of the axis of revolution. As shown in FIG. 1, the axes of maximum sensitivity of the microphone array are coplanar and are arranged such that the sensor designated L1 is aimed at $-65°$ (or counterclockwise from the positive direction,) the sensor designated R1 is aimed at +65°, and the sensors designated L2 and R2 are aimed at −165° and +165°, respectively. The connections to the transducers defining these patterns are symbolically shown by the conductors 10, 12, 14 and 16 which, in turn, are connected to an encoder 18. The encoder includes four all-pass phase shift networks 20, 22, 24 and 26, the first two of which provide a phase-shift as a function $\psi$ of frequency, with the latter two providing a phase-shift which is a ($\psi-90°$) function of frequency. A fractional portion (about 70%) of the phase-shifted R2 signals from phase-shift network 24 is added in a summing junction 30 to the phase-shifted L1 signal from phase-shift network 20 to produce at an output terminal 32 a first composite signal, designated LT. Similarly, approximately 70% of the phase-shifted L2 signal from phase shift network 26 is added in a second summing junction 34 to the phase-shifted R1 signal from phase shift network 22 to produce a second composite output signal, RT at an output terminal 36. It is shown in the aforementioned application that the output signals LT and RT are equivalent to those required by the SQ quadraphonic system to establish the directional position of sound sources surrounding the microphone array, the above choice of 70% for the output of L2 and R2 being a modification envisioned by the aforementioned U.S. Pat. No. 4,072,821.

In subsequent U.S. Pat. No. 4,096,353 the applicant showed that a system having a performance equivalent to that of the previous system (which used four gradient microphones and a single omnidirectional microphone) is achieved with but two gradient microphones and a single omnidirectional microphone. This is achieved by the system illustrated in FIG. 2A wherein two gradient microphone units 40 and 42 are supported on a common vertical axis X—X with their axes of maximum sensitivity positioned at azimuthal angles of 90° and 0°, respectively; that is, the gradient elements are at 90° relative to each other. The microphone elements are placed as close as possible to each other and also in close proximity to an omnidirectional transducer element 44. If an azimuth of 0° is arbitrarily selected as the reference direction, it is clear that the voltage output of the gradient element 42 for a sound wave of given sound pressure level will vary as the cosine of the angle of incidence with respect to the azimuth around the axis X—X measured from 0°, and the voltage output of the gradient element 40 for the same sound wave will vary as the sine function of the angle of incidence. These signals are designated $E_c$ and $E_s$, respectively, and the voltage output from the omnidirectional microphone 44 for the aforementioned sound wave, which does not vary with azimuth, is designated $E_o$. Assuming normalization to unity of the voltages $E_c(0°)$, $E_s(90°)$ and $E_o$ for the aforementioned sound wave, the polar plot shown in FIG. 3 suggests the manner in which the various signals must be combined to achieve the purposes of the invention.

Figure 3:
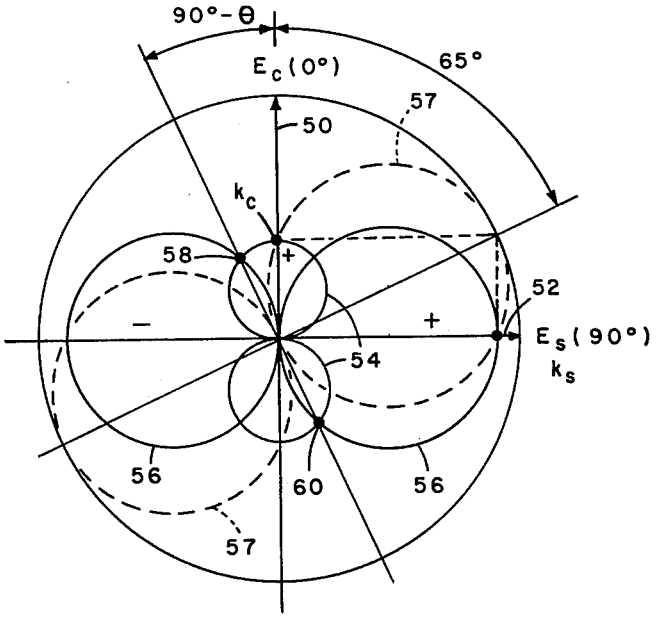
FIG. 3 is an explanatory diagram for FIG. 2A.

In FIG. 3, the voltage $E_c$ (0°) is represented by the arrow 50 oriented in the 0° and having unity length. Similarly, the voltage $E_s$ (90°) is represented by the arrow 52 in the 90° direction and of unity length. It is to be understood that the arrows 50 and 52 are not phasors; they simply represent the magnitudes of the output voltages of the respective transducers for the particular directions of sound incidence. It being an object of the invention to provide a system equivalent in performance to that of the FIG. 1 system, it is necessary to form an equivalent gradient element oriented in a direction $\theta$, namely, at the angles at which the limaćon patterns of FIG. 1 are aimed, by combining fractional portions of the signals $E_c$ and $E_s$ in appropriate proportions. Defining the proportions of $E_c$ and $E_s$ by the factors $k_c$ and $k_s$, respectively, the polar patterns of the respective gradient microphones for these fractional outputs are shown at 54 and 56, and are defined by equations, for pattern 54, $$k_cE_c=k_cE_c(0°)\cos\eta$$

and for pattern 56, $$k_sE_s=k_sE_s(90°)\sin\theta$$

It is seen that one lobe of each pattern is positive and the other negative as indicated by the plus and minus signs. The null crossing of the pattern takes place when the positive and negative circles intersect, that is, at points 58 and 60, respectively. At these points, $k_cE_c=k_sE_s$ and since $E_c(0°)$—$(E_s(90°)=1$, then $$\frac{E_s(90°)\sin\theta}{E_c(0°)\cos\theta}=\frac{\sin\theta}{\cos\theta}=\tan\theta$$

by simply setting $k_s=\sin\theta$ and $k_c=\cos\theta$, then the maximum value of the voltage of the newly formed gradient pattern 57—57 becomes $E(\theta)-\cos^2\theta+\sin^2\theta=1$.

The just-discussed relationships suggest the diagram shown in FIG. 4 for convenient visualization of the matrix system needed to produce the directional patterns depicted in FIG. 1. The voltages $E_c(0°)$ and $E_s(90°)$ are again shown as arrows 50' and 52', respectively, and additionally the diagram includes arrows representing the gradient transducer voltages L1 (at −65°), R1 (at +65°), L2 (at −165°) and R2 (at +165°), these corresponding to the similarly designated directional patterns in FIG. 1. By projecting the arrows representing these voltages on the 0°−180° and +90°−90° axes, the following respective coefficients of the required matrix are obtained:

| Gradient Component | $k_c$ | $k_s$ |
|---|---|---|
| L1g(−65°) | cos −65° = .423 | sin −65° = −.906 |
| R1g(+65°) | cos +65° = .423 | sin +65° = .906 |
| L2g(−165°) | cos −165° = −.966 | sin −165° = −.259 |
| R2g(+165°) | cos 165° = −.966 | sin +165° −.259 |

Figure 2A:
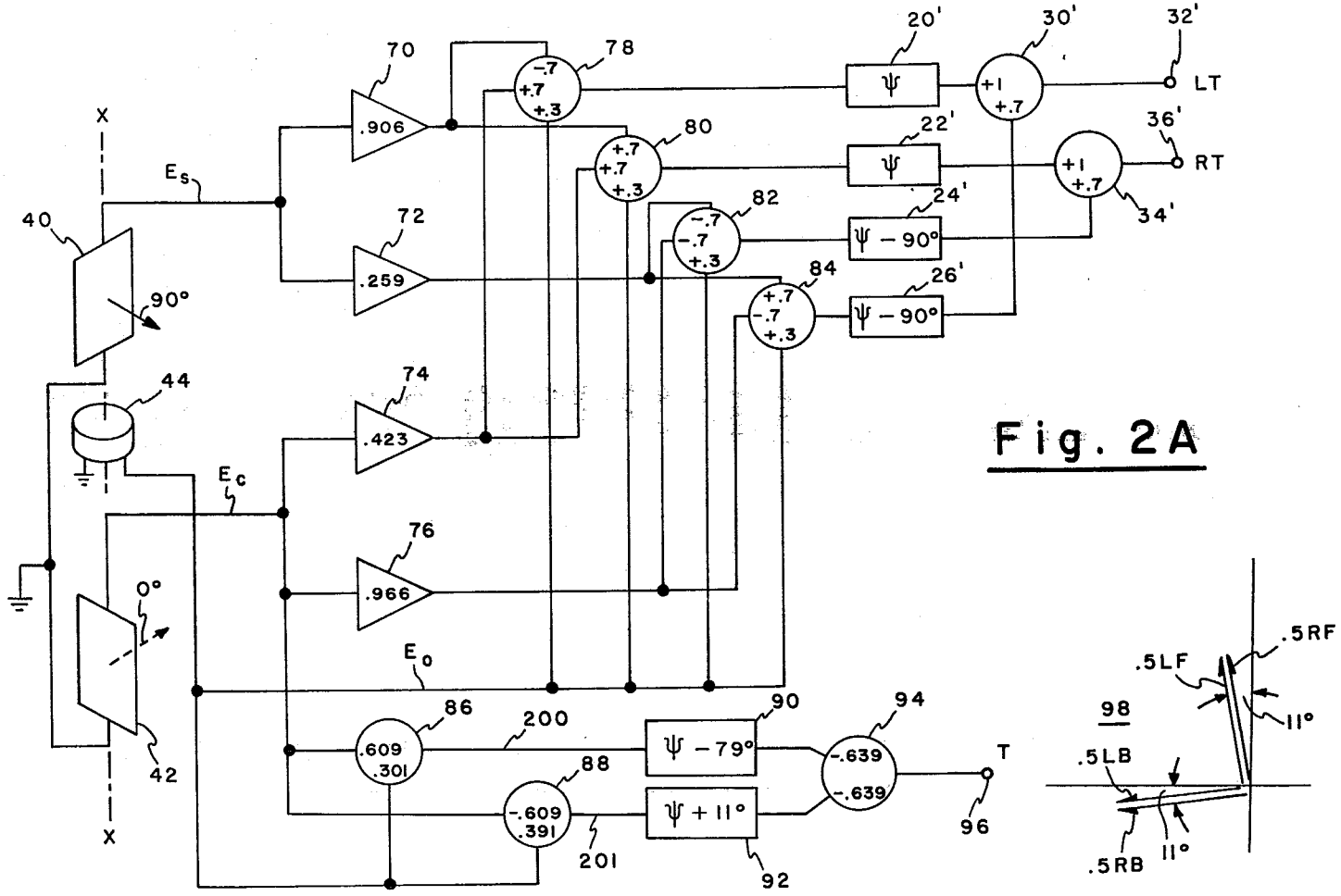
FIG. 2A is a schematic representation of the details of FIG. 1, including added elements needed to produce the T function for enabling the microphone system to function in the $\theta$-3-4 mode.

Thus, the appropriate directions for the four limaćon patterns depicted in FIG. 1 can be obtained with the microphone array shown in FIG. 2A by combining the $E_s$ and $E_c$ signals in accordance with the coefficients set forth in the above table. To this end, the $E_s$ signal is applied to the input of both of two amplifiers 70 and 72 designed to have amplification factors of 0.906 and 0.259, respectively, and the $E_c$ signal is applied to the input terminal of both of two additional amplifiers 74 and 76, designed to have amplification factors of 0.423 and 0.966, respectively. The output signals from these four amplifiers are combined according to the above table in respective summing junctions 78, 80, 82 and 84, being added at the junction with a further multiplicand of 0.7 for each of them. More particularly, and by way of example, 0.7 of the output signal from amplifier 70 (which is equal to 0.906 $E_s$) is subtracted in junction 78 from 0.7 of the output signal from amplifier 74. The remaining 0.3 (30%) of each of the output signals is contributed by the voltage $E_o$ from the omnidirectional transducer 44, 0.3 of which is applied as an input to each of the summing junctions 78, 80, 82 and 84. This summation process produces the desired limacon patterns shown in FIG. 1 and designated in FIG. 2 as L1, R1, L2 and R2. These signals are applied to an encoding section, in all respects like the encoder 18 in FIG. 1, which is operative to produce the desired encoded composite output signals LT and RT at output terminals 32' and 34', respectively.

Figure 2B:
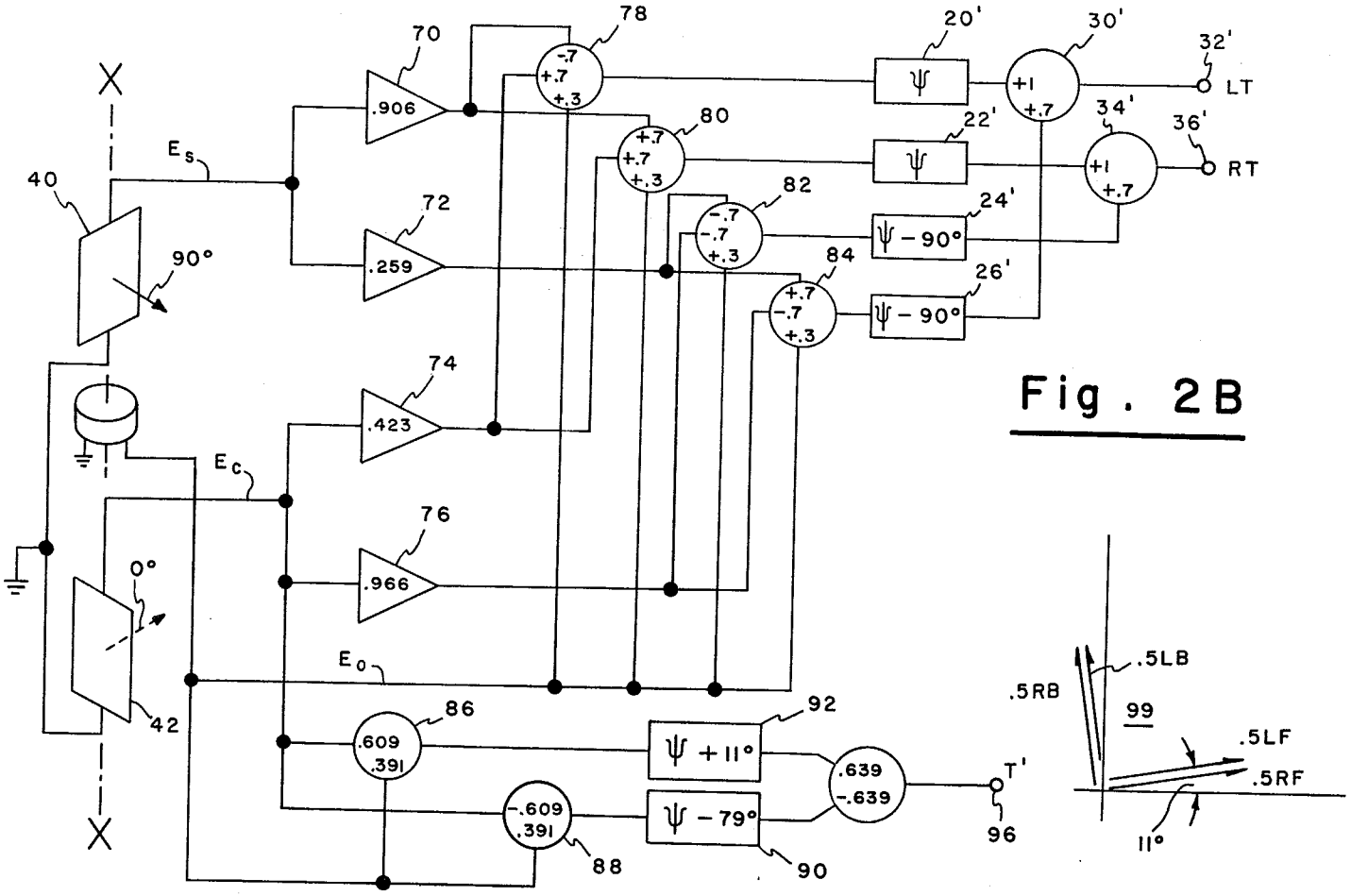
FIG. 2B is another embodiment of the invention with a modified method of producing a new T-function, T', which leads to the use of the simpler, lower cost decoding apparatus described in the co-pending application.

It should be noted that FIG. 2A depicts at its bottom added elements which enable the objectives of this invention to be carried out. These elements have the purpose of extracting the function "T" from the $E_c$ and $E_o$ signals as will be described later in greater detail. FIG. 2B is a modified arrangement of producing the T-function, which leads to simpler decoding structures than can be obtained with FIG. 2A, also to be described later.

Another aspect of the invention described in U.S. Pat. No. 4,096,353 is the applicant's recognition that by appropriate adjustment of a commercially available microphone array and judicious combination of the output signals produced thereby it is possible to achieve the desired encoded composite signals LT and RT. For example, a microphone commercially available from the Neuman Company of West Berlin consists of four independent cardioid (or limacon) pattern units mounted at 180° to each other, but adjustable so that their respective axes may be set at 90° relative to each other. Applicant has recognized that if the respective axes of this commercially available microphone are set at 90° relative to each other as shown in FIG. 5, it is possible to derive therefrom the three signals $E_c$ $E_s$ and $E_o$ obtained with the microphone array described in connection with FIG. 2A system which, when modified and combined as shown in FIG. 2A, will produce properly encoded composite signals LT and RT. More specifically, if one pair of the transducers of such microphone, having respective polar patterns 90 and 92, are oriented along the 0°-180° direction, the equations of these cardioid patterns are $0.5+0.5 \cos \theta$ and $0.5-0.5 \cos \theta$, respectively. The signal representative of pattern 92 is subtracted in a summing junction 94 form the signal representative of the pattern 90 thereby to produce at an output terminal 96 a voltage $E_c=\cos \theta$. The other pair of transducers, the directional patterns of which are depicted at 98 and 100 are oriented in the +90°—90° direction and follow the equations $0.5+0.5 \sin \theta$ and $0.5-0.5 \sin \theta$, respectively. The signal representative of the limacón pattern 100 is subtracted in a summing junction 102 from the signal representative of pattern 98 to produce at an output terminal 104 a voltage $E_s= \sin \theta$. When the two signals representative of either of the pairs are added together they produce a voltage $E_o=1$, or if the signals representative of all four patterns are summed, each with a coefficient of 0.5, the resultant is also $E_o$. The latter summation is illustrated in FIG. 5 where the four pattern-representing signals are added, each with a coefficient of 0.5, in a summing junction 106 to produce at the output terminal 108 the voltage $E_o$. It should be noted that it would have been sufficient to use any of the two oppositely directed pattern-representing signals with coefficients of 1.0, to obtain $E_o$; the use of all four signals, however, as shown in FIG. 5, is preferable as it better represents any possible variations of level with aging of components, etc. The resulting $E_c$ $E_s$ and $E_o$ signals have such sine, cosine, and omnidirectional characteristics that when they are applied to the matrix and encoding system described in FIGS. 2A and 2B the resulting composite signals LT and RT will have the characteristics required for the SQ quadraphonic system.

The operation of the Microphone System herein described is illuminated by referring to FIGS. 6A-B-C. In FIG. 6A the four limacon patterns have been redrawn to clarity in rectangular coordinates, and it is assumed that L2 and R2 have been multiplied by coefficient=0.7, which is within the scope of the U.S. Pat. No. 4,072,821. Let us consider the −50° azimuth, where both R1 and L2 cross the 0 output line. Since these two terms constitute the RT output, only LT output exists. This LT signal consists of two components, $L1=0.3+0.7 \cos (65°-50°)=0.98$, and a quadrature components $R2=0.7[0.3+0.7 \cos (50°+165°)]=-0.19$. This latter component is added at 90° lagging phase as shown in FIG. 6B in the upper left corner, the two components forming a unity signal. Therefore, the −50° incidence of sound corresponds to the left signal of stereo or the left-front signal of SQ.

An opposite situation obtains at the +50° incidence where the R1 and the L2 components yield a total sum of unity as shown in the upper right-hand corner of FIG. 6B, and L1 and R2 components are 0, thus corresponding to the right channel of stereo or the right-front channel of SQ.

Proceeding next to −130° azimuth we note that this is the intersection angle for L1 and L2, both of which, for this angle, provide a relative output of approximately 0.60. Also, we note that at −130°, R1 and R2 are very nearly equal in magnitude providing realtive amplitudes of approximately 0.40, but of opposite sign. With these observations in mind, we construct the outputs LT and RT for −130° sound incidence shown in the lower left part of FIG. 6B, and we note that the resultant output voltages, LT and RT, are very nearly equal and in quadrature with each other, with RT lagging behind LT by very nearly 90°. This is the requirement for producing the LB signal of SQ. In the same manner it is shown that for +130°, the LT and RT outputs for the microphone system herein described are almost precisely equivalent to those required to produce an RB signal of the SQ system code.

Figure 6D:
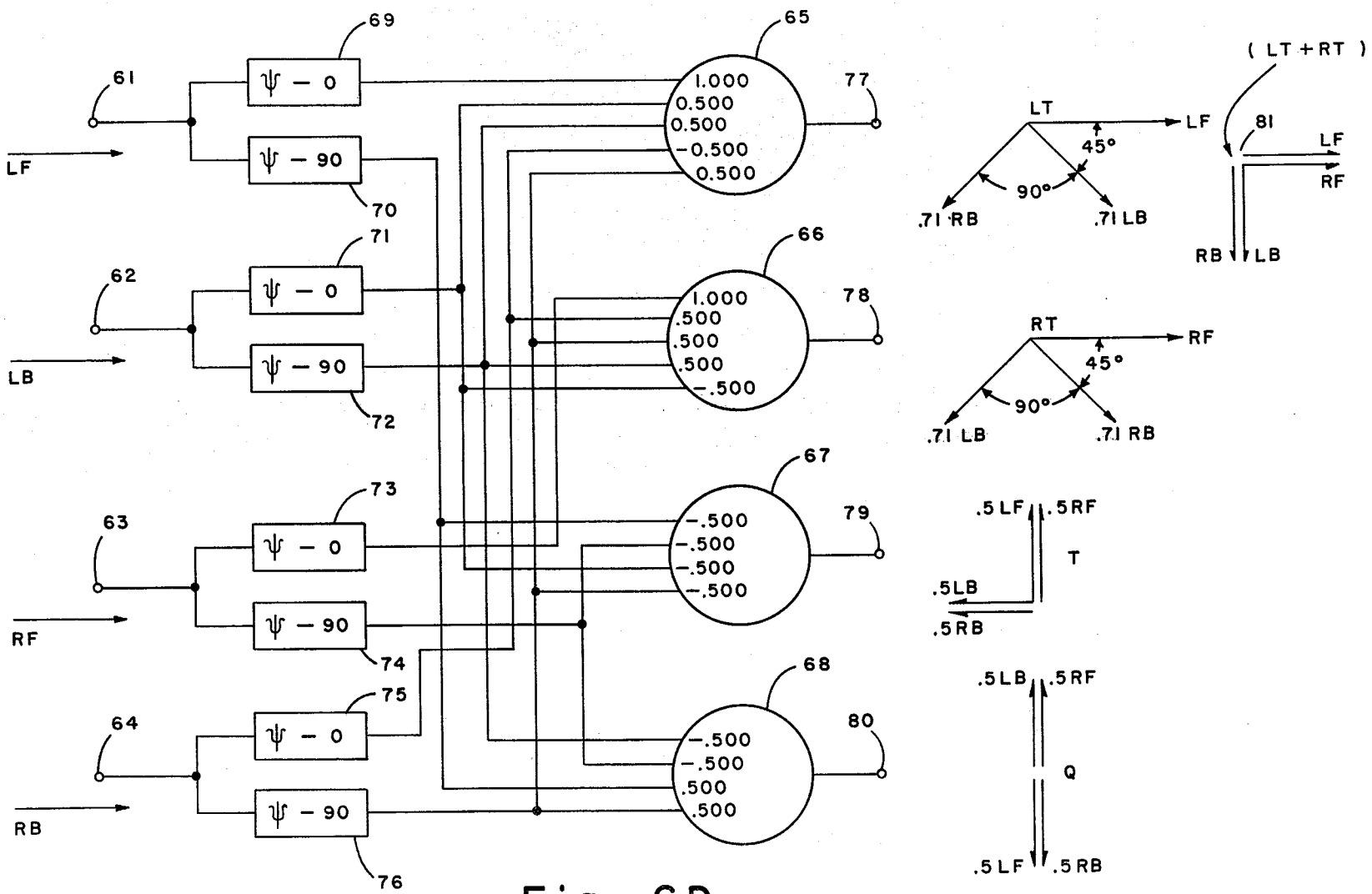
FIG. 6D is a diagram of an encoder from the co-pending application to illustrate the relationship between the LT and RT and the T signals.

It is helpful at this point to bring together the sets of phasors LT and RT corresponding to the four cardinal directions LF, RF, LB and RB and this is done in FIG. 6C which depicts the composite signals LT and RT, made by combining together the appropriate phasors from FIG. 6B. Comparing these composite signals with the corresponding signals LT and RT produced by the encoder in FIG. 6 of the aforementioned co-pending patent application (for convenience reproduced in this specification as FIG. 6D) it is noted that the signals LT and RT are almost identical with the corresponding signals LT and RT in 6D, except that the former are tilted at approximately 11° with respect to the horizontal or "0°" base line. This, of course, is of no consequence because what matters in the operation of the decoder is the relative phase relationship between LT and RT, and this relative relationship is the same in both FIGS. 6C and 6D.

Referring again to FIG. 6D, it will be noted that the encoder shown therein produces a signal T which, in cooperation with the decoded signals LT and RT is capable of producing a 4-3-4 type of decoding action. It is one of the purposes of the present invention to provide this type of action with the spatial microphone array herein described. It is noted from inspection of FIG. 6D that of the signals which form T, those designated as 0.5LF and 0.5RF are in quadrature with (or perpendicular to) LF and RF components of LT and RT. At the same time, the component phasors of T designated as 0.5LB and 0.5RB are perpendicular with respect to its components 0.5LF and 0.5RF. Since it has been shown that the phasor groups LT and RT in FIG. 6C are rotated counter-clockwise with respect to the corresponding signals LT and RT in FIG. 6D, it also follows that the signal T necessary to effectuate the 4-3-4 or $\theta$-3-4 operation of the microphone of this invention also has to be equally shifted in phase counter-clockwise (leading) by approximately 11°. An important objective of this invention was to appropriately form such a signal T with the transducers used in this invention.

Figure 7:
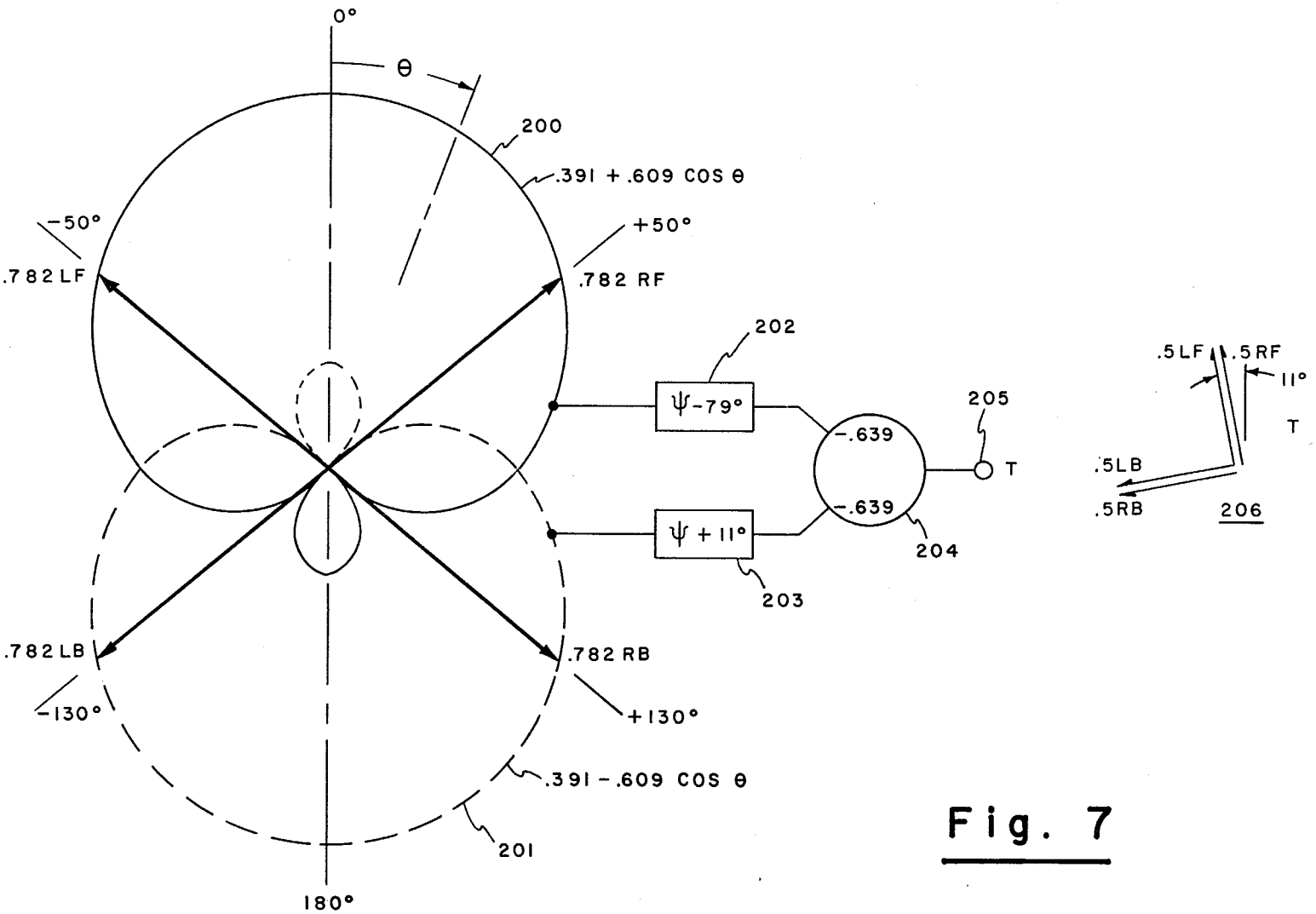
FIG. 7 is a diagram for explaining the formation of the T signal according to the invention.

The applicant discovered that the abovementioned objective could be carried out as explained in FIG. 7, which depicts two back-to-back hypercardioid patterns, 200 and 201. The pattern 200 is comprised of 0.391 parts of signal from an omnidirectional microphone and 0.609 parts of signal from a microphone responding to the cosine of the angle of incidence $\theta$. The pattern 201 is similarly formed, but the cosine portion is added in a reverse sense. These two patterns have a characteristic of exhibiting zero response for sounds originating from angles at ±130° from the direction of maximum incidence. This is because $$0.391+0.609 \cos \pm 130^\circ=0$$

and correspondingly $$0.391-0.609 \cos \pm 50^\circ=0$$

Therefore, remembering that LF and RF signal positions for the microphone array of this invention are located at ±50° and the LB and RB positions correspond to directions of incidence of ±130°, respectively, it is clear that the array 200, does not respond to LB or RB signals, while the array 201 does not respond to LF and RF signals.

Since the relative amplitude of signals picked up by the hypercardioid-pattern microphones at ±50°, is $$0.391+0.609 \cos \pm 50^\circ=0.782$$

these coefficients are the ones shown in FIG. 7 for the specified cardinal directions LF, RF, LB and RB. These four signals, in corresponding pairs are passed through phase shift networks 202 and 203 which provide phase shifts ($\psi-79°$) and ($\psi+11°$). Their outputs, in turn, are summed at junction No. 204 using negative coefficients 0.639 for both signals. The relative amplitudes of the cardinal signals, thus, is $0.782\times0.639=0.5$. The resulting signal T, therefore, exhibits the desired 11° counter-clockwise rotation, as shown by the phasor group 206 to conform with the position of phasor groups LT and RT in FIG. 6C. It will be noted that this phasor group is precisely equal to the phasor group T in FIG. 6D except for the previously referred to counter-clockwise rotation of 11°.

Referring now to FIG. 2A, at the bottom of the figure, it is seen that the omnidirectional and the cosine transducer signals $E_o$ and $E_c$ required for the formation of the hypercardioid previously referred to in FIG. 7, already are available in the matrix of the microphone array, and therefore it is possible to provide these functions by making suitable connections as shown at the bottom of FIG. 2A, where the summing junctions 86 and 88 are connected to sources of voltages $E_o$ and $E_c$, which in turn provide the outputs carried by leads 200 and 201 to phase shift networks 90 and 92, the outputs of which are summed in the summing junction 94 to produce the signal T at the terminal 96. This signal is then portrayed by the phasor group 98 at the lower right-hand side of FIG. 2A. This is precisely the T signal needed to result in 4-3-4 or $\theta$-3-4 action when used with the decoder of FIG. 10 in my co-pending application.

Figure 8:
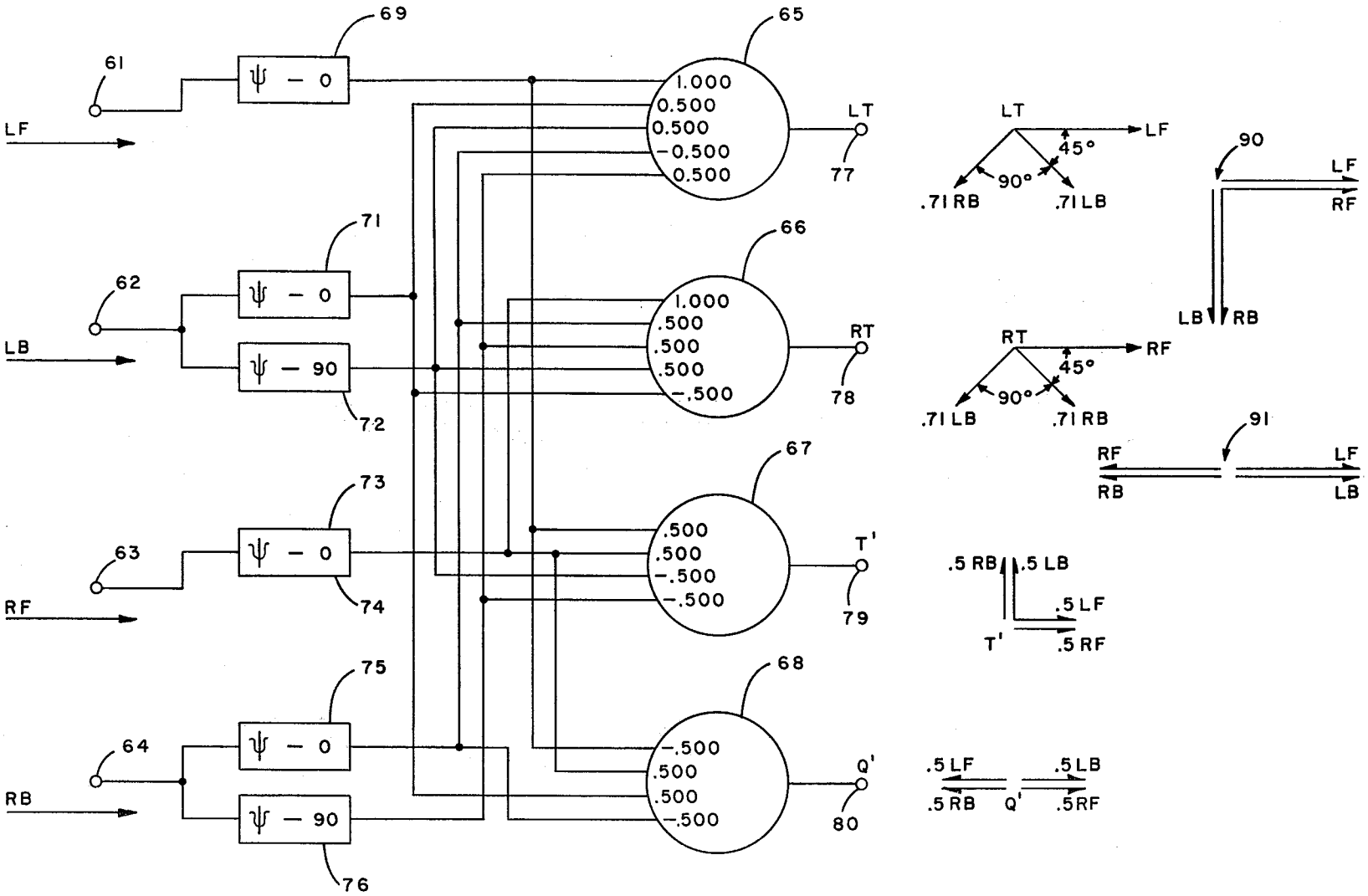
FIG. 8 is a reproduction of an alternative encoder from the co-pending application to illustrate the relationship between the LT and RT and the alternative T' signal formed by the device in FIG. 2B.

My co-pending application shows a different type of encoder configured to produce a signal T′ which allows the 4-3-4 decoding action to be performed with a simpler decoder, depicted in FIG. 11 of my co-pending application. It should be noticed that the characteristic of this encoder, which is shown in FIG. 8 of this present application is that its phasors 0.5LF and 0.5RF of the signal T′ are in phase with, or parallel to, the corresponding phasors LF and RF in LT and RT, and also that the phasors 0.5RB and 0.5LB are perpendicular with respect to the phasors 0.5LF and 0.5RF. In applying this principle to the phasors LT and RT in FIG. 6C of this application, which are displaced in phase counter-clockwise by approximately 11°, it follows that T′ in FIG. 8 should likewise be turned counter-clockwise by approximately 11° in order to produce the proper 4-3-4 action with the output signals LT and RT of the microphone described in this specification. This attitude is achieved in the embodiment in FIG. 2B in a manner similar to that used in FIG. 2A, resulting in a phasor group 99 in FIG. 2B which responds to the required relationship between the signal T′ and the signals LT and RT, for proper decoding in the decoder depicted in FIG. 11 of my co-pending application, as hereinbefore stated.

Because the signals LT, RT, and T or T′ formed in the structure herein described are the result of linear addition of signals, either non-phase-shifted or phase-shifted in specified manner, it is evident that the configuration of the circuits, the numbers of phase-shift networks, and the position thereof within the circuit may be changed considerably to establish the desired performance parameters without departing from the spirit of this invention.

I claim:

1. Apparatus for producing principal first and second composite signals LT and RT, respectively, and an auxiliary third composite signal T, where LT comprises the sum of a predominant left-front (LF) signal component and sub-dominant left-back (LB) and right-back (RB) signal components and RT comprises the sum of a predominant right-front (RF) signal component and said subdominant LB and RB components and in which the LB and RB signal components lead and lag, respectively, the LB and RB components in said LT signal by a predetermined differential phase-shift angle, said apparatus comprising:

means including a plurality of microphones in close proximity to each other for producing when disposed within a field of surround-sound sources of sound, four signals each defined by a predetermined limacon sensitivity pattern having the equation $E=K+(1-k)\cos\theta$ whose directions of maximum sensitivity are oriented at different predetermined azimuthal angles relative to a reference direction, wherein k is a constant having a value less than one, $\theta$ is the angle between said reference direction and the axis of maximum sensitivity of each microphone; and E is the normalized amplitude of the voltage produced by an incident sound wave of unity pressure, means for shifting the phase of a first of said four signals relative to a second of said four signals by a predetermined phase angle and combining said phase-shifted first and second signals to produce said first principal composite signal, means for shifting the phase of a third of said four signals relative to the fourth of said four signals by a predetermined phase angle and combining said phase-shifted third and fourth signals to produce said second principal composite signal, means including at least some of said plurality of microphones for producing when disposed within said field of surround-sound sources of sound, first and second intermediate signals each representative of a predetermined limacon sensitivity pattern having the equations $E=m+(1-m)\cos\theta$ and $E=m-(1-m)\cos\theta$, respectively, wherein $\theta$ is the angular direction measured from the direction of maximum sensitivity and m is a constant where $0<m<1$, and means for combining said first and second intermediate signals and for producing said auxiliary third composite signal T containing, to the extent they are present, equal proportions of LF, LB, RF and RB signal components which exhibit an equal angular relationship with respect to corresponding signal components in a composite signal representing the sum of LT and RT.

2. Apparatus according to claim 1, wherein the angular relationship between corresponding directional signals in said composite signal T and in a composite signal representing the sum of LT and RT is one of perpendicularity.

3. Apparatus according to claim 1, wherein the angular relationship between corresponding directional signals in said composite signal T and in a composite signal representing the sum of LT and RT is one of parallelism.

4. Apparatus according to claim 1 or claim 2 or claim 3, wherein said predetermined phase angle is about 90°.

5. Apparatus for producing principal composite signals LT and RT and an auxiliary composite signal T for use in a matrix quadraphonic sound system wherein first and second channels carry the composite signals LT and RT, respectively, and wherein each principal composite signal contains predetermined amplitude portions of three or more directional input signals representative of corresponding acoustical signals, to the extent they are present, in predetermined phase relationships, the composite signals when decoded by a decoder appropriate to the matrix system producing three or more output signals each containing a different directional signal as its predominant component, the apparatus for producing the said composite signals comprising, in combination:

means comprising a plurality of microphones supported in close proximity to each other for producing when disposed within a sound field a plurality of signals the relative amplitudes of which is a measure of the direction of incidence of a sound signal relative to a reference direction, said array comprising first and second gradient microphones supported with the axis of maximum sensitivity of said first microphone in said reference direction and with the axis of maximum sensitivity of said second microphone in a direction azimuthally displaced from said reference direction by 90° for respectively producing a first and a second of said plurality of signals, the amplitudes of which vary as the cosine and sine, respectively, of the azimuthal angle defined by said reference direction and the direction of arrival of an incident acoustical signal, and an omnidirectional microphone for producing a third of said plurality of signals the amplitude of which is invariant with direction of acoustical signal incidence, means for combining a predetermined portion of said third signal with each of four selected combinations of predetermined portions of said first and second signals for producing first, second, thrid and fourth intermediate signals each representative of a predetermined limacon sensitivity pattern having the equation $E=k+(1-k)\cos\theta$ whose directions of maximum sensitivity are oriented at different predetermined angles relative to said reference direction, means for relatively shifting the phase of said first and second intermediate signals by a predetermined phase angle and for combining said relatively phase-shifted first and second intermediate signals for producing the LT signal, means for relatively shifting the phase of said third and fourth intermediate signals by a predetermined phase angle and for combining said relatively phase-shifted third and fourth intermediate signals for producing the RT signal, means including at least some of said plurality of microphones for producing fifth and sixth intermediate signals each representative of a predetermined limacon sensitivity pattern having equations $E=m+(1-m)\cos\theta$ and $E=m-(1-m)\cos\theta$, respectively, wherein $\theta$ is the angular direction measured from the direction of maximum sensitivity and m is a constant where $0<m<1$, and means for combining said fifth and sixth intermediate signals for producing said auxiliary composite signal T containing, to the extent they are present, equal proportions of all of the directional signals contained in said LT and RT composite signals, which exhibit an equal angular relationship with respect to corresponding directional signals contained in a composite signal representing the sum of LT and RT.

6. Apparatus according to claim 5, wherein the angular relationship between corresponding directional signals in said T signal and in a composite signal representing the sum of LT and RT is one of perpendicularity.

7. Apparatus according to claim 5, wherein the angular relationship between corresponding directional signals in said T signal and in a composite signal representing the sum of LT and RT is one of parallelism.

8. Apparatus for producing principal composite signals LT and RT and an auxiliary composite signal T, for use in a matrix quadraphonic sound system wherein first and second channels carry the composite signals LT and RT, respectively, and wherein each composite signal contains predetermined amplitude portions of three or more directional input signals representative of corresponding acoustical signals, to the extent they are present, in predetermined phase relationships, the composite signals when decoded by a decoder appropriate to the matrix system producing three or more output signals each containing a different directional signal as its predominant component, the apparatus for producing the composite signals comprising, in combination:

an array of microphones comprising an assembly of four transducers in close proximity to each other each having a limacon sensitivity pattern defined by the equation $E=0.5+0.5 \cos \theta$ and whose directions of maximum sensitivity are azimuthally displaced one from the other by about 90°, and the direction of maximum sensitivity of a first of which is oriented in said reference direction, for producing when disposed within a sound field a plurality of signals the relative amplitudes of each of which is a function of the angle $\theta$ between the direction of incidence of a sound signal and said reference direction, means for combining the signals produced by the two transducers disposed on the axis coincident with said reference direction for producing a first signal the amplitude of which varies as the cosine of said angle $\theta$, means for combining the signals produced by the two transducers disposed on the axis disposed at 90° to said reference direction for producing a second signal the amplitude of which varies as the sine of said angle $\theta$, means for combining selected signals produced by at least two of said transducers for producing a third signal the amplitude of which is invarient with the direction of incidence of a sound signal, means for combining a predetermined portion of said third signal with each of four selected combinations of predetermined portions of said first and second signals for producing first, second, third and fourth intermediate signals each representative of a predetermined limacon sensitivity pattern whose directions of maximum sensitivity are oriented at different predetermined angles relative to said reference direction, means for relatively shifting the phase of said first and second intermediate signals by about 90° and for combining said relatively phase-shifted first and second intermediate signals for producing the LT signal, means for relatively shifting the phase of said third and fourth intermediate signals by about 90° and for combining said relatively phase-shifted third and fourth intermediate signals for producing the RT signal, means for adding to and subtracting from a predetermined portion of said third signal a predetermined portion of said second signal for producing fifth and sixth intermediate signals, means for relatively shifting the phase of said fifth and sixth intermediate signals by a predetermined phase angle, and means for combining predetermined portions of said relatively phase-shifted fifth and sixth intermediate signals for producing said auxiliary composite signal T containing, to the extent they are present in the sound field, equal proportions of all of the directional signals contained in said LT and RT composite signals, which exhibit an equal angular relationship with respect to corresponding directional signals contained in a composite signal representing the sum of LT and RT.

9. Apparatus according to claim 8, wherein the angular relationship between corresponding directional signals in said T signal and in a composite signal representing the sum of LT and RT is one of perpendicularity.

10. Apparatus according to claim 8, wherein the angular relationship between corresponding directional signals in said T signal and in a composite signal representing the sum of LT and RT is one of parallelism.

* * * * *

UNITED STATES PATENT AND TRADEMARK OFFICE

CERTIFICATE OF CORRECTION

PATENT NO. : 4,262,170

DATED : April 14, 1981

INVENTOR(S) : Benjamin B. Bauer, deceased by Ida Bauer, executrix

It is certified that error appears in the above-identified patent and that said Letters Patent are hereby corrected as shown below:

Column 4, line 10 "cos $\eta$" should be -- cos $\theta$ --.

Column 4, line 21 "($E_s$(90°)=1" should be

-- $E_s$(90°)=1 --

Column 10, line 20 "thrid" should be -- third --.

Signed and Sealed this

*Seventh* Day of *July 1981*

[SEAL]

*Attest:*

RENE D. TEGTMEYER

*Attesting Officer* *Acting Commissioner of Patents and Trademarks*